US005653128A

United States Patent [19]

Warren, Jr. et al.

[11] Patent Number: 5,653,128

[45] Date of Patent: Aug. 5, 1997

[54] SELF-SUPPORTING SOCKS PROVIDING IMPROVED BLOOD CIRCULATION IN THE LEGS OF THE USER

[76] Inventors: William K. Warren, Jr.; Andrew Nathaniel Warren; Dana Elizabeth Warren, all of 2445 E. 28th St., Tulsa, Okla. 74114

[21] Appl. No.: 592,561

[22] Filed: Jan. 26, 1996

[51] Int. Cl.[6] ..... A41B 11/00

[52] U.S. Cl. ..... 66/172 E; 2/239

[58] Field of Search ..... 2/239; 66/185 R, 66/172 E, 188

[56] References Cited

U.S. PATENT DOCUMENTS

| | | | |
|---|---|---|---|
| 1,238,196 | 8/1917 | Roedelheim | 2/239 |
| 2,193,056 | 3/1940 | Burn | 2/239 |
| 2,220,803 | 11/1940 | Lesher | 66/172 E |
| 2,268,818 | 1/1942 | Goodman | 2/239 X |
| 2,513,639 | 7/1950 | Goodman | 2/239 |
| 2,904,980 | 9/1959 | Stinson | 2/239 X |
| 3,146,468 | 9/1964 | McDonald | 2/239 |
| 3,728,875 | 4/1973 | Hartigan et al. | 66/172 E |
| 4,048,818 | 9/1977 | Cueman | 66/172 E |
| 4,561,267 | 12/1985 | Wilkinson et al. | 66/178 A |
| 5,131,099 | 7/1992 | Zellweger | 2/239 |

FOREIGN PATENT DOCUMENTS

| | | | |
|---|---|---|---|
| 101227 | 6/1937 | Australia | 2/239 |
| 651061 | 9/1937 | Germany | 66/172 E |
| 375527 | 11/1939 | Italy | 2/239 |

*Primary Examiner*—John J. Calvert

*Attorney, Agent, or Firm*—Head, Johnson & Kachigian

[57] ABSTRACT

A self-supporting sock providing for improved blood circulation in the leg of the user, the sock being formed by knitted fabric, the sock being of a height to extend below the knee of the user and having an elastic band at the top having elastic threads therein, the elastic band having a notch formed therein extending in a direction towards the sock heel portion, the notch being substantially the full length of the elastic band.

9 Claims, 1 Drawing Sheet

SELF-SUPPORTING SOCKS PROVIDING IMPROVED BLOOD CIRCULATION IN THE LEGS OF THE USER

REFERENCE TO PENDING APPLICATIONS

This application is not related to any pending applications.

REFERENCE TO MICRO-FICHE APPENDIX

This application is not referenced in any microfiche appendix.

BACKGROUND OF THE INVENTION

Hosiery worn to cover the feet and lower legs of the user that do not extend above the knee are referred to as socks. A type of sock commonly worn, especially by men, dress socks, and by both sexes for work socks or socks worn during athletic activity, have a leg length that does not extend above the mid-calf part of the leg when in normal position. Such socks are formed of knitted fabric. In approximately 1940 to 1945 a type of sock became popular in which elastic threads were encompassed in the stitching of the knitted fabric. A popular pattern developed in which the knitted threads are laid into a number of knitted courses adjacent the top of the sock. The area of the sock at the top having the elastic threads encompassed therein constitutes an elastic band. The function of the elastic band is to closely adhere to the calf of the leg of the user when the sock is positioned on the leg so as to keep the sock "up," that is, to keep the top portion of the sock as positioned on the leg of the user. Without elasticity in the top portion of the sock, socks would not cling or adhere to the leg calf portion and would thus slide down and settle around the ankle of the user, a problem that would be considered unacceptable by the normal wearer. Therefore, to make certain that socks stay up, that is, that the elastic band securely grips the mid-calf portion of the leg of the user, hosiery manufacturers characteristically include an elastic band of one to two inches in height at the top of the sock. Further, to insure that the socks stay up, the hosiery is manufactured such that the elastic bands tightly grip the leg of the user.

One problem that exists in manufacturing hosiery is that hosiery must be designed so that the elastic bands will grip the mid-calf portion of a wide variety of mid-calf circumferences. Therefore, a manufacturer of hosiery must design socks so that they will securely adhere to the mid-calf portion of the leg of the thinnest, normal expected consumer, which means that the elastic tension on the leg of a user of the normal or above normal circumferential areas will, at times, be excessive. This excessive elastic tension around the leg of the user can apply sufficient compressive force to interfere with the normal blood circulation in the lower portion of the leg of the user. This interference with blood circulation may be significant with some users, while many others are able to tolerate the normal constrictive force applied by the elastic band of socks without noticing deleterious effects from the blood flow constriction.

The present disclosure is concerned with improved sock construction that alleviates the tendency of socks, on at least some users, to apply excessive elastic tension around the leg of the user and to thereby result in decreased blood circulation in the lower portion of the user's leg.

For background information as to the construction of socks of the type to which this disclosure pertains, reference may be had to the following U.S. Patents:

| PATENT NO. | INVENTOR | TITLE |
|---|---|---|
| 3,728,875 | Hartigan et al | Stocking With Soft Inner Thigh Area |
| 4,048,818 | Cueman | Therapeutic Stocking and Method |
| 4,561,267 | Wilkinson et al | Knitted Sock |
| 5,131,099 | Zellweger | Sock and Process For Production Thereof |

BRIEF SUMMARY OF THE INVENTION

This invention provides a self-supporting sock that provides improved blood circulation in the legs of the user. The improved sock is formed of knitted fabric in the usual way that socks are characteristically manufactured today, the specific manufacturing process depending upon a variety of factors including the type of materials employed and the use of the sock. The sock of this disclosure is of the mid-length type, that is, the type wherein the top edge of the sock is approximately of a height that encompasses the mid-calf portion of the leg of the user.

The sock is typically of a knitted fabric having a knitted foot portion with a toe portion extending in one direction and a heel portion in the other. Integrally knitted above the foot portion is a leg portion having an upper edge. An elastic band is formed in the leg portion at and extending downwardly from the top edge. The elastic band has elastic threads formed therein, the threads extending circumferentially around the leg of the user. The height of the typical leg band may be approximately one to two inches. The elastic band portion of the sock may be ribbed which is done for two purposes—for improved appearance at the top of the sock and to augment the function of the elastic band to cause the top of the sock to closely adhere to the leg of the user to thereby keep the sock up, that is, to prevent the sock from sliding down around the ankles of the user.

Formed in the elastic band is a notch. The notch is formed by opposing edges that converge toward each other in a downward direction. The notch formed in the elastic band portion of the sock extends from the top edge and may be a generally V-shaped notch or a generally U-shaped notch. The notch is formed in the portion of the elastic band that is above the sock heel portion so that thereby the notch will be on the calf of the leg of the user.

To augment the ability of the sock to adhere to the leg of the user when provided with a notch portion, supplemental elastic threads may be positioned horizontally in the sock extending from the edge of the notch. Further, the upper edge of the sock, including the edges of the notch, may be slightly augmented with elastomeric reinforcement.

The sock of this disclosure removes the circumferential compressive force applied around the calf portion of the leg of the user to thereby remove a restriction to blood flow through the leg. It is well-known that a compressive force around the exterior of an extremity, such as the leg, can, if applied tightly enough, completely shut off the flow of blood in the leg portion. This is exemplified by a tourniquet or a sphygmomanometer. While the elastic force of a typical sock as commonly employed today is not sufficient normally to completely cut off the blood flow of the user, any compressive tension applied around the full circumference of the leg has a tendency to, in some degree, restrict blood flow. The amount of the restriction can vary considerably from one person to another, and in some people is of insignificance but in others, the restriction of the blood flow can be significant. The sock of this disclosure eliminates the circumferential compressive force applied around the leg of the user to thereby permit blood circulation in the leg of the user in a more normal pattern.

A better understanding of the invention will be obtained from the following description of the preferred embodiments taken in conjunction with the attached drawings.

DESCRIPTION OF THE DRAWINGS

FIG. 1 shows the improved invention wherein the sock has a notch formed in the upper elastomeric band.

DETAILED DESCRIPTION OF THE PREFERRED EMBODIMENTS

Figure 1:
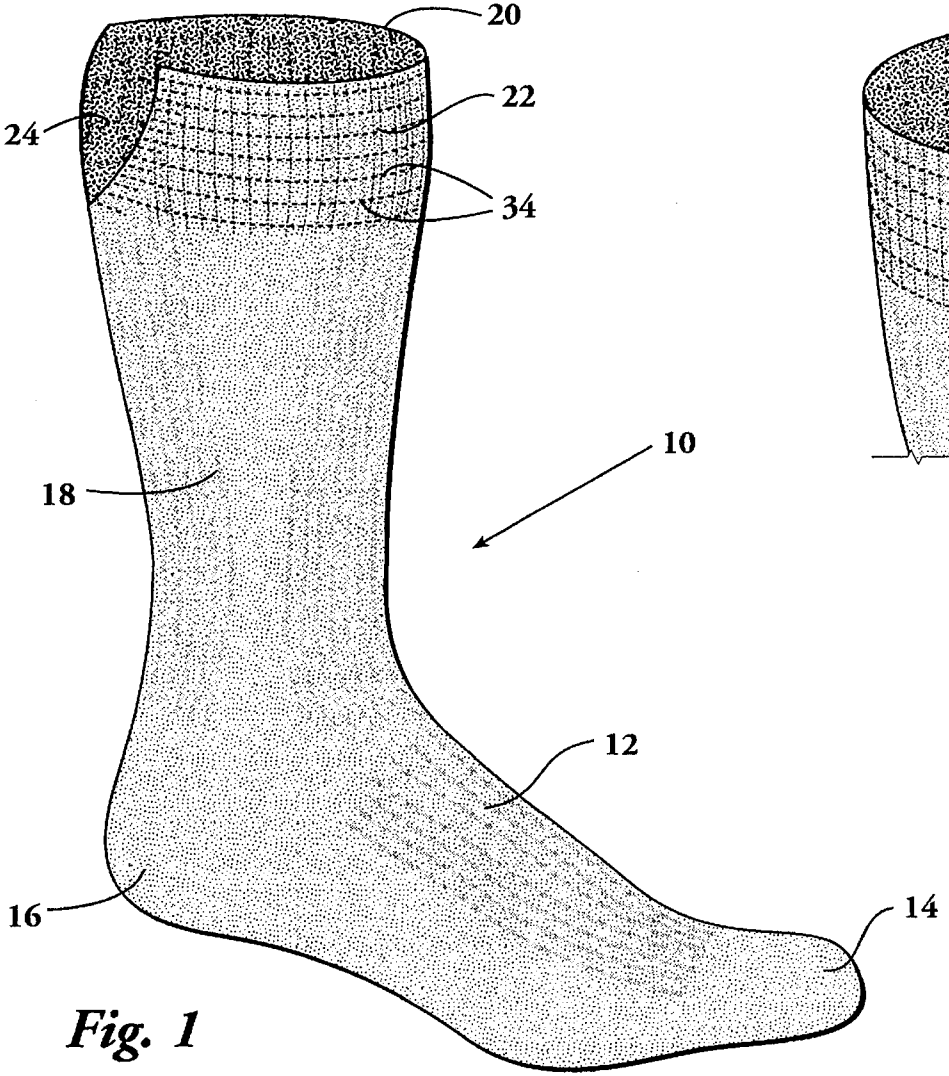
FIG. 1 is an elevational isometric view of a sock that incorporates the principles of this invention, the sock being of the type wherein the top edge fits around the calf of the user, that is, wherein the sock top is below the knee of the user.

Referring to the drawings, first to FIG. 1, a sock that illustrates the invention is indicated generally by the numeral 10. The sock 10 has a foot portion 12 having toe portion 14 at one end, and a heel portion 16 at the other. Integrally formed with foot portion 12 is leg portion 18, having an upper edge 20. Adjacent upper edge 20 is an elastic band portion 22. The elastic band is formed by including circumferential elastic threads formed in the knitted fabric of which the sock is made. The function of the elastic band is to grip around the leg of the user. The height of sock 10 is such that the upper edge 20 fits around the calf portion of the leg of the user. Thus sock 20 is less than knee-length, and elastic band portion 22 is necessary to keep the sock up, that is, to keep it from falling down around the ankles of the user.

The height of elastic band 22 may vary but typically is about one inch to about two inches. Further, elastic band 22 may be ribbed, that is, knitted so that integral, vertical ribs are formed in the sock. These ribs, which are customary in men's dress socks and also frequently in crew socks, augment the function of elastic band 22 and improve the appearance of sock 10.

The sock described up to this point is of standard construction and commonly employed, at least in the Westernized world, as dress socks for men and as crew socks or other types of socks worn by both males and females for work or recreation. The sock functions very well, that is, elastic band 22 is highly effective in keeping the sock in its selected height position, but a problem develops among some users in that the constriction caused by elastic band 22 can interfere with blood circulation. While in some users the effect on blood circulation is minimal and may not even be noticed, on other users the effect can be noticeable. In fact, some users experience swelling in the ankles and feet. To overcome the deleterious effect of excessive constriction caused by elastic band 22, this invention employs the use of a notch 24 formed in the upper portion of the sock. As shown in FIG. 1, notch 24 extends from the top edge 22 downwardly in the direction towards heel portion 16 and is in the rear portion of the sock, that is, the calf portion of the sock.

Figure 2:
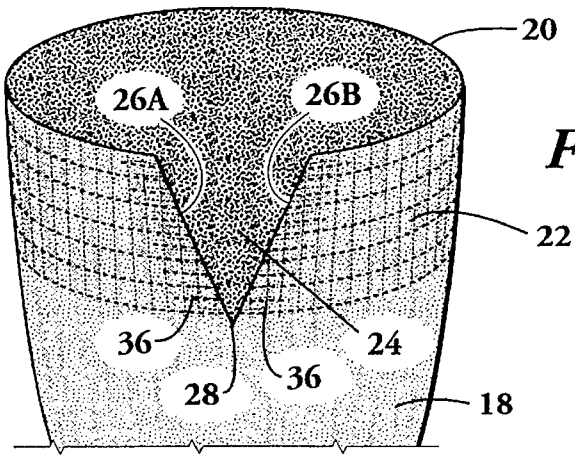
FIG. 2 is a partial, elevational isometric view taken from the rear of a sock of the type as shown in FIG. 1, wherein the notch formed in the sock is of a V-shaped configuration.
Figure 3:
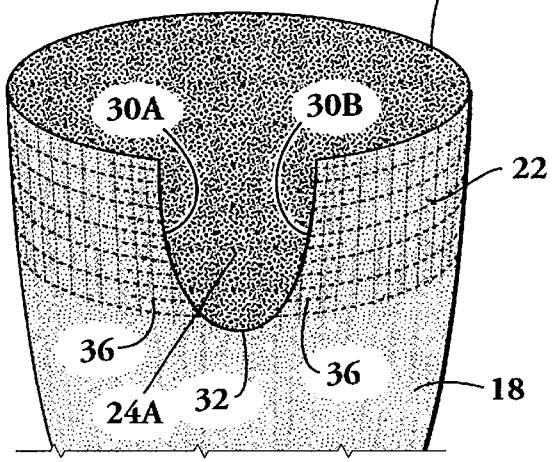
FIG. 3 is a partial, elevational isometric view of a sock as shown in FIG. 1 wherein the notch is of U-shaped configuration.

FIGS. 2 and 3 show exemplary ways in which notch 24 may be formed. In FIG. 2, notch 24 is a V-shaped construction, whereas in FIG. 3, the notch 24A is a U-shaped construction. The V-shaped notch of FIG. 2 has opposed downwardly extending edges 26A and 26B that meet at an apex 28. Apex 28 is preferably at about the lower end of elastic band 22. That is, notch 24 is preferably formed of a dimension to substantially coincide with that of the elastic band.

In the embodiment of FIG. 3, edges 30A and 30B meet in a U-shaped arrangement at an apex 32 that is about on the same horizontal level as the lower end of elastic band 22.

In the embodiment of FIG. 2, notch edges 26A and 26B form an alteration of the upper edge 20, and in like manner, in FIG. 3 the edges 30A and 30B form a part of the sock upper edge 20.

As previously stated, the type of sock as commonly employed today that is configured to reach to the calf portion of the leg of the user has horizontal circumferential elastic threads that are indicated by dotted lines at 34. In the typical sock that does not have the notches shown in the illustration of FIGS. 1–3, these elastic threads 34 extend circumferentially around the full perimeter of the upper portion of the sock. With the provision of notch 24, the circumferentiality of elastic bands 34 is interrupted so as to substantially decrease the constriction applied around the leg of the user. In some instances, it is desirable to augment the holding characteristic of the socks so that they will remain in place. Supplemental elastic threads 36 extend from notch edges 24A and 24B or 30A and 30B, depending upon whether the notches are V or U-shaped. These supplemental elastic threads 36 extend only partially around the full periphery of the sock and may extend for a distance of one-half inch up to as much as one-quarter of the full circumference of the sock. The supplemental elastic threads 36 improve the characteristic of the sock to stay in position around the leg of the user without imparting a constrictive force as is occasioned by the use of fully circumferential elastic threads.

The upper edge 20, as well as notch edges 26A, 26B and 36A, 36B, may have integral supplementary reinforcing such as supplemental elastomeric thread (not shown) extending around the edge. Or the sock may have an edge that is otherwise reinforced and finished in the same way that socks are commonly manufactured and on the market today.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A self supporting sock providing for improved blood circulation in the legs of the user, the sock being formed of knitted fabric having a knitted foot portion with a toe portion at one end and a heel portion at an opposite end, and an upwardly extending leg portion having a top, the leg portion extending to a height of a calf of a user, and the sock having an elastic band at said top of said leg portion, the elastic band having circumferential elastic threads as a part of said knitted fabric, said elastic band having an upper edge, the sock being characterized by an open notch in said elastic band, said notch extending in a direction towards said heel portion, said notch being defined by opposed downwardly extending edges and including supplemental elastic threads formed in said knitted fabric adjacent said opposed downwardly extending edges, said supplemental elastic threads being positioned substantially horizontally in said knitted fabric.

2. A knitted sock according to claim 1 in which said notch is of such depth in said direction towards said heel portion that said notch extends substantially through said elastic band.

3. A knitted sock according to claim 1 in which said notch is of V-shaped configuration.

4. A knitted sock according to claim 1 in which said notch is of U-shaped configuration.

5. A knitted sock according to claim 1 in which said upper edge and said notch are defined by a continuous integral reinforcement formed by said knitted fabric.

6. A self-supporting sock providing for improved blood circulation in the legs of the user, the sock being formed of knitted fabric having a knitted foot portion with a toe portion at one end and a heel portion at an opposite end, and an upwardly extending leg portion, the leg portion having an upper edge of a height of a calf of a user, comprising:

an elastic band at said upper edge of said leg portion, the elastic band having horizontal circumferential elastic threads included in said knitted fabric;

a notch formed in said elastic band, said notch having opposed edges downwardly extending from said top edge in the direction towards said heel portion;

a continuous integral reinforcement formed by said knitted fabric defining said top edge and said notch opposed edges; and supplemental elastic threads placed substantially horizontally in said knitted fabric and extending from said notch opposed edges.

7. A knitted sock according to claim 6 in which said notch is of such depth in the direction toward said heel portion that the notch extends substantially through said elastic band.

8. A knitted sock according to claim 6 in which said notch is of V-shaped configuration.

9. A knitted sock according to claim 6 in which said notch is of U-shaped configuration.

* * * * *